US010215427B2

(12) United States Patent
Lu et al.

(10) Patent No.: US 10,215,427 B2
(45) Date of Patent: Feb. 26, 2019

(54) AIR CONDITIONING SYSTEM AND METHOD FOR CONTROLLING AIR CONDITIONING SYSTEM

(71) Applicant: Carrier Corporation, Farmington, CT (US)

(72) Inventors: Qing Lu, Shanghai (CN); Guangyu Shen, Shanghai (CN)

(73) Assignee: CARRIER CORPORATION, Farmington, CT (US)

( * ) Notice: Subject to any disclaimer, the term of this patent is extended or adjusted under 35 U.S.C. 154(b) by 575 days.

(21) Appl. No.: 14/781,377

(22) PCT Filed: Apr. 1, 2014

(86) PCT No.: PCT/US2014/032500

§ 371 (c)(1),
(2) Date: Sep. 30, 2015

(87) PCT Pub. No.: WO2014/165497

PCT Pub. Date: Oct. 9, 2014

(65) Prior Publication Data

US 2016/0033158 A1 Feb. 4, 2016

(30) Foreign Application Priority Data

Apr. 1, 2013 (CN) ..... 2013 1 0110179

(51) Int. Cl.
*F24F 3/08* (2006.01)
*F25B 23/00* (2006.01)
(Continued)

(52) U.S. Cl.
CPC ..... *F24F 3/08* (2013.01); *F24F 5/0003* (2013.01); *F24F 11/83* (2018.01); *F24F 11/89* (2018.01);
(Continued)

(58) Field of Classification Search
CPC .... F24F 11/89; F24F 11/83; F24F 3/08; F24F 5/0003; F24F 11/85; F24F 11/84; F24F 2140/12; F25B 23/006
(Continued)

(56) References Cited

U.S. PATENT DOCUMENTS 1,166,712 A * 1/1916 Otterson ..... B60P 1/60 406/115
1,185,754 A * 6/1916 Anderson ..... F16F 9/3405 188/317
(Continued)

FOREIGN PATENT DOCUMENTS

CN 1598427 A 3/2005
CN 1629556 A 6/2005
(Continued)

OTHER PUBLICATIONS

International Search Report for application PCT/US2014/032500, dated Apr. 1, 2014, 5 pages.
(Continued)

*Primary Examiner* — Claire Rojohn, III
(74) *Attorney, Agent, or Firm* — Cantor Colburn LLP

(57) ABSTRACT

An air conditioning system (1) includes an outdoor subsystem, an indoor subsystem and a power module (3) for driving a cooling medium. The outdoor subsystem is configured with a plurality of parallel branches (4) and said branches (4) comprise a branch inlet and a branch outlet, each branch (4) is configured with an outdoor unit (5) and a first control valve (6). The air conditioning system includes a controller (7), a first pressure sensor (8) and a second pressure sensor (9), the controller (7) comprises a first pressure difference determination module that communicates with the first pressure sensor and the second pressure sensor, and a first control module of the first pressure difference that communicates with the first pressure differ-
(Continued)

ence determination module and the first control valve (4), where the first pressure difference determination module determines the pressure difference between the outlet and the inlet of the branches.

8 Claims, 2 Drawing Sheets

(51) Int. Cl.

| | |
|---|---|
| ***F24F 5/00*** | (2006.01) |
| ***F24F 11/83*** | (2018.01) |
| ***F24F 11/89*** | (2018.01) |
| *F24F 140/12* | (2018.01) |
| *F24F 11/84* | (2018.01) |
| *F24F 11/85* | (2018.01) |

(52) U.S. Cl.
CPC ..... *F25B 23/006* (2013.01); *F24F 11/84* (2018.01); *F24F 11/85* (2018.01); *F24F 2140/12* (2018.01)

(58) Field of Classification Search
USPC ..... 165/284
See application file for complete search history.

(56) References Cited

U.S. PATENT DOCUMENTS

| | | | | |
|---|---|---|---|---|
| 2,193,066 | A * | 3/1940 | Gill | F17C 7/04 122/32 |
| 4,760,707 | A * | 8/1988 | Dennis | F25B 5/00 62/197 |
| 8,000,629 | B2 * | 8/2011 | Tamura | G03G 21/1828 399/107 |
| 9,003,823 | B2 * | 4/2015 | Tanaka | F25B 13/00 62/335 |
| 2008/0000629 | A1 * | 1/2008 | Viczena | F28D 1/05316 165/260 |
| 2011/0166712 | A1 * | 7/2011 | Kramer | G05D 23/1919 700/278 |
| 2011/0185754 | A1 * | 8/2011 | Yamashita | F24F 11/83 62/132 |
| 2012/0193066 | A1 * | 8/2012 | Lowther | F24F 3/08 165/11.1 |
| 2012/0255320 | A1 * | 10/2012 | Kawagoe | F24D 17/0005 62/238.6 |
| 2014/0026603 | A1 * | 1/2014 | Toya | F24F 1/0003 62/129 |
| 2014/0060105 | A1 * | 3/2014 | Azuma | F24F 3/065 62/324.1 |
| 2015/0285518 | A1 * | 10/2015 | Shimamoto | F25B 13/00 62/186 |
| 2015/0316284 | A1 * | 11/2015 | Tanaka | F25B 13/00 62/196.1 |
| 2016/0146496 | A1 * | 5/2016 | Yamashita | F25B 13/00 62/190 |

FOREIGN PATENT DOCUMENTS

| | | | |
|---|---|---|---|
| CN | 101561173 | A | 10/2009 |
| CN | 101614421 | A | 12/2009 |
| CN | 201416985 | Y | 3/2010 |
| CN | 101782260 | A | 7/2010 |
| CN | 202757347 | U | 2/2013 |
| EP | 1698843 | A2 | 9/2006 |
| EP | 2012068 | A1 | 1/2009 |
| JP | S5347046 | A | 4/1978 |
| JP | S58130915 | A | 8/1983 |
| JP | H0926186 | A | 1/1997 |
| JP | H10238842 | A | 9/1998 |
| JP | 3666167 | B | 6/2005 |
| JP | 2007163075 | A | 6/2007 |
| JP | 2009019842 | A | 1/2009 |

OTHER PUBLICATIONS

Pump Express, "Conversion from Constant Flow System to Variable Flow", http://www.pumpexpress.com/pumps/pdfs/34014_2.pdf, accessed Sep. 30, 2015, 7 pages.
Written Opinion for application PCT/US2014/032500, dated Jul. 21, 2014, 6 pages.
Chinese First Office Action and Search Report for application CN 201310110179.1, dated Dec. 17, 2015, 10 pages.
Wenhou, Huang et al., "VWV control strategies of chillers in primary pump systems", HV&AC vol. 34, 2004, pp. 65-69.

* cited by examiner

AIR CONDITIONING SYSTEM AND METHOD FOR CONTROLLING AIR CONDITIONING SYSTEM

FIELD OF THE INVENTION

The present invention relates to an air conditioning system and a method for controlling the air conditioning system.

DESCRIPTION OF THE RELATED ART

The European Patent Application EP2012068 that was assigned to Rhoss S.p.a. by Zen et al. proposes a method for regulating the delivery temperature of a fluid from a refrigerating machine. Said patent discloses a refrigerating machine for an air-conditioning system, which comprises: one or more fan coils and a hydronic circuit having a delivery branch for the circulation of a service fluid from the refrigerating machine to the fan coils and a return branch for the return of the service fluid in input to the refrigerating machine, the compressor of the machine is switched on and off as a function of a measurement of the delivery temperature such that the same delivery temperature converges to a set point temperature (TSET), and this set point temperature (TSET) is adapted to an estimate of the cooling/heating load of the hydronic circuit.

Chinese Patent Application CN101561173 disclosed by Wei Zhanhai proposes a power saving system for central air conditioning circulation pump. The patent discloses an apparatus that uses a frequency variation technique to regulate the increase or decrease of the rotation speed of the circulation pump for keeping the pressure difference between the water inlet pipe and the water return pipe of the fan coils constant, comprising: a temperature measurement device disposed at the air outlet of the central air conditioning system; a return valve for regulating its opening degree according to the data displayed by the temperature measurement device such that the air outlet temperature is constant, which is disposed on the water return pipe of each fan coil; a solenoid valve disposed in front of the return valve except for the two fan coils at the end such that the circulating water does not pass through the fan coils when the air conditioner is not used; further comprising a pressure gauge disposed on the water outlet pipe of the circulation pump and a frequency transformer that matches the circulation pump, the pressure gauge signals are sent to the frequency transformer, the frequency transformer sends frequency variation signals to the power switch of the circulation pump for controlling the rotation speed of the circulation pump such that the pressure difference between the water inlet pipe and the water return pipe of the fan coils is kept constant.

Japanese Patent Application JP2007163075 assigned to Kitz by Nishida proposes a flow control system. The flow control system disclosed by the patent comprises: a main piping for circulating cold/hot water delivered from a cold/hot water generator; fan coils connected to the main piping via supply pipes and return pipes for leading and returning the cold/hot water from and to the main piping, respectively; flow control valves for controlling the flow rates of the cold/hot water that flow in the return pipes; and bypass piping arranged on the return pipes to bypass-connect the upstream and downstream sides of the flow control valves.

Chinese Patent Application CN101614421 disclosed by Xiao Jiaxiang proposes a fan coil. The patent discloses a special fan coil for a single-tube chilled water system, which comprises a salver, a chilled water coil, a water inlet tube and a water outlet tube which are communicated with the chilled water coil, a centrifugal fan, a return air inlet and an air outlet, the water inlet tube is equipped with a DC variable-frequency water pump, and the centrifugal fan is driven by a DC variable-frequency motor.

Japanese Patent Application JP58130915 assigned to Mitsubishi Electric Corp. by Hama et al. proposes an air conditioning system and hot water supply apparatus. The patent discloses an air conditioning system in which both the flow resistances of a waterway on a hot water exchange side and the flow resistances of a waterway on a fan coil unit side can be regulated by means of a manual valve.

Japanese Patent Application JP9026186 assigned to Osaka Gas Co., Ltd. by Kobayashi et al. proposes a refrigerating circulating air conditioning system. The patent discloses an air conditioning system that improves the supply balance from the refrigerator to the heat exchanger of the fan coil unit by correcting the interlayer pressure difference of the refrigerator, which comprises: a controller on the fan coil unit in each room for regulating the room temperature by regulating the opening degree of an expansion valve, which measures temperatures at the inlet side and the outlet side of the heat exchanger of the fan coil unit from the refrigerator so as to control the supply from the refrigerator to the heat exchanger based on the temperature difference, and it is set in such a way that the maximum opening degree of the expansion valve of the fan coil unit on each layer is decreased gradually from the top layer to the bottom layer during the cooling operation, or the maximum opening degree of the expansion valve of the fan coil unit on each layer is increased gradually from the bottom layer to the top layer during the heating operation.

The US Patent Application US20110166712 disclosed by Kramer et al. discloses a deadband control of pneumatic control devices. The patent discloses a pneumatic control device, which comprises a branch pressure sensor that may be a single pressure transducer configured to measure both branch and main pressure. For a two-pipe system, the pneumatic solenoid valve is stopped only during a pressure change event, such as to charge or vent the branch line.

The US Patent Application US20110185754 assigned to Mitsubishi Electric Corp. by Yamashita et al. proposes an air-conditioning apparatus capable of lowering the rotation speed of the pump when the air-conditioning load is decreased, and raising the rotation speed of the pump when the air-conditioning load is increased. The patent discloses an air-conditioning apparatus for covering the air-conditioning load, which comprises: a first pump and a second pump, the rotation speed of these pumps may be varied according to the change in the air-conditioning load of the use side heat exchangers so that the heat medium outlet temperature of the first intermediate heat exchanger or the second intermediate heat exchanger detected by the first temperature sensors approaches the target value.

However, the above air conditioning systems are usually not able to change the amount of outdoor units in actual operations according to the demand. Since the valves at the outdoor unit side according to the prior art are typically manual valves constantly in the open state, it is impossible to regulate the flow rate of the cooling medium at the outdoor unit side, as shown in FIG. 1. Moreover, an indoor unit has different cooling and heating requirements in different seasons of a year and the amount of indoor units with cooling/heating demand varies from time to time. The air conditioning systems according to the prior art are unable to effectively regulate the flow rate of the cooling medium and consequently, it is difficult to carry out optimization of the energy consumption of the entire air conditioning system. The amount of indoor units is limited and is typically smaller than 128.

SUMMARY OF THE INVENTION

In light of this, according to a first aspect of the present invention, an air conditioning system is provided, which effectively solves the above problems and other problems in the prior art. In the air conditioning system according to the present invention, the air conditioning system comprises an outdoor subsystem, an indoor subsystem and a power module for driving a cooling medium, the outdoor subsystem is configured with a plurality of parallel branches and said branches comprise a branch inlet and a branch outlet, wherein the cooling medium flows into the indoor subsystem through the power module and the outdoor subsystem, performs heat exchange with the indoor air in an indoor unit of the indoor subsystem, and subsequently returns to an outdoor unit of the outdoor subsystem through the power module for heat exchange, thereby forming a circulation of the cooling medium.

Each branch is configured with an outdoor unit and a first control valve, the air conditioning system further comprises a controller, a first pressure sensor for measuring the pressure at the branch inlet and a second pressure sensor for measuring the pressure at the branch outlet, the controller comprises a first pressure difference determination module that communicates with the first pressure sensor and the second pressure sensor, and a first control module of the first pressure difference that communicates with the first pressure difference determination module and the first control valve, wherein the first pressure difference determination module receives the pressure at the branch inlet and the pressure at the branch outlet from the first pressure sensor and the second pressure sensor, and determines the pressure difference between the outlet and the inlet of the branches.

In an embodiment of the air conditioning system according to the present invention, the pressure difference between the outlet and the inlet of the branches measured by the first pressure difference determination module is greater than a first predetermined value, then the first control module of the first pressure difference instructs to increase the amount of the first control valves that are open, and/or The pressure difference between the outlet and the inlet of the branches measured by the first pressure difference determination module is between the first predetermined value and a second predetermined value, then the first control module of the first pressure difference instructs to regulate the flow rate of the cooling medium in the air conditioning system, and/or The pressure difference between the outlet and the inlet of the branches measured by the first pressure difference determination module is smaller than the second predetermined value, then the first control module of the first pressure difference instructs to decrease the amount of the first control valves that are open, Wherein the first predetermined value is greater than the second predetermined value.

In another embodiment of the air conditioning system according to the present invention, the power module further comprises a variable frequency pump for regulating the flow rate of the cooling medium, and the controller further comprises a second control module of the first pressure difference that communicates with the variable frequency pump and the first pressure difference determination module.

In yet another embodiment of the air conditioning system according to the present invention, the pressure difference between the outlet and the inlet of the branches measured by the first pressure difference determination module is greater than a third predetermined value, then the second control module of the first pressure difference instructs to decrease the flow rate of the variable frequency pump; and/or The pressure difference between the outlet and the inlet of the branches measured by the first pressure difference determination module is smaller than a fourth predetermined value, then the second control module of the first pressure difference instructs to increase the flow rate of the variable frequency pump, and/or The pressure difference between the outlet and the inlet of the branches measured by the first pressure difference determination module is between the third predetermined value and the fourth predetermined value, then the second control module of the first pressure difference instructs to keep the flow rate of the variable frequency pump constant, Wherein the third predetermined value is greater than the fourth predetermined value, the third predetermined value is smaller than the first predetermined value, and the fourth predetermined value is greater than the second predetermined value.

In another embodiment of the air conditioning system according to the present invention, a second control valve is disposed on the bypass formed between the inlet and the outlet of the indoor subsystem, the air conditioning system further comprises a third pressure sensor for measuring the inlet pressure of the indoor subsystem and a fourth pressure sensor for measuring the outlet pressure of the indoor subsystem, the controller comprises a second pressure difference determination module that communicates with the third pressure sensor and the fourth pressure sensor, the second pressure difference determination module receives the inlet pressure and the outlet pressure of the indoor subsystem from the third pressure sensor and the fourth pressure sensor, and determines the pressure difference between the outlet and the inlet of the indoor subsystem, and the controller further comprises a second pressure difference control module that communicates with the second control valve and the second pressure difference determination module.

In another embodiment of the air conditioning system according to the present invention, the pressure difference between the outlet and the inlet of the indoor subsystem measured by the second pressure difference determination module is greater than a fifth predetermined value, then the second pressure difference control module instructs to increase the opening degree of the second control valve; and/or The pressure difference between the outlet and the inlet of the indoor subsystem measured by the second pressure difference determination module is smaller than a sixth predetermined value, then the second pressure difference control module instructs to decrease the opening degree of the second control valve, and/or The pressure difference between the outlet and the inlet of the indoor subsystem measured by the second pressure difference determination module is between the fifth predetermined value and the sixth predetermined value, then the second pressure difference control module instructs to keep the opening degree of the second control valve unchanged, Wherein the fifth predetermined value is greater than the sixth predetermined value.

In yet another embodiment of the air conditioning system according to the present invention, the first control valve is a solenoid valve.

In yet another embodiment of the air conditioning system according to the present invention, the cooling medium is water.

According to a second aspect of the present invention, moreover, an air conditioning system is also provided, the air conditioning system comprises an outdoor subsystem, an indoor subsystem and a variable frequency pump for regulating the flow rate of a cooling medium, the air conditioning system further comprises a controller, a first pressure sensor for measuring the inlet pressure of the outdoor subsystem, and a second pressure sensor for measuring the outlet pressure of the outdoor subsystem, the controller comprises a first pressure difference determination module that communicates with the first pressure sensor and the second pressure sensor, and a second control module of the first pressure difference that communicates with the first pressure difference determination module and the variable frequency pump, wherein the first pressure difference determination module receives the inlet pressure of the outdoor subsystem and the outlet pressure of the outdoor subsystem from the first pressure sensor and the second pressure sensor, and determines the pressure difference between the outlet and the inlet of the outdoor subsystem.

In yet another embodiment of the air conditioning system according to the present invention, The pressure difference between the outlet and the inlet of the outdoor subsystem measured by the first pressure difference determination module is greater than a third predetermined value, then the second control module of the first pressure difference instructs to decrease the flow rate of the variable frequency pump, and/or The pressure difference between the outlet and the inlet of the outdoor subsystem measured by the first pressure difference determination module is between the third predetermined value and a fourth predetermined value, then the second control module of the first pressure difference instructs to keep the flow rate of the variable frequency pump constant, and/or The pressure difference between the outlet and the inlet of the outdoor subsystem measured by the first pressure difference determination module is smaller than the fourth predetermined value, then the second control module of the first pressure difference instructs to increase the flow rate of the variable frequency pump, Wherein the third predetermined value is greater than the fourth predetermined value.

According to a third aspect of the present invention, moreover, a method for controlling an air conditioning system is further provided, the air conditioning system comprises an outdoor subsystem, an indoor subsystem and a power module for driving a cooling medium, the outdoor subsystem is configured with a plurality of parallel branches and said branches comprise a branch inlet and a branch outlet, wherein the cooling medium flows into the indoor subsystem through the power module and the outdoor subsystem, performs heat exchange with the indoor air in an indoor unit of the indoor subsystem, and subsequently returns to an outdoor unit of the outdoor subsystem through the power module for heat exchange, thereby forming a circulation of the cooling medium, Each branch is configured with an outdoor unit and a first control valve, the air conditioning system further comprises a controller, a first pressure sensor for measuring the pressure at the branch inlet and a second pressure sensor for measuring the pressure at the branch outlet, the controller comprises a first pressure difference determination module that communicates with the first pressure sensor and the second pressure sensor, and a first control module of the first pressure difference that communicates with the first pressure difference determination module and the first control valve, In Step 1, the first pressure difference determination module receives the pressure at the branch inlet and the pressure at the branch outlet from the first pressure sensor and the second pressure sensor;

In Step 2, the first pressure difference determination module determines the pressure difference between the outlet and the inlet of the branches;

In Step 3, the first control module of the first pressure difference compares the pressure difference between the outlet and the inlet of the branches with a first predetermined value and a second predetermined value, wherein, When the pressure difference between the outlet and the inlet of the branches is greater than the first predetermined value, the first control module of the first pressure difference instructs to increase the amount of the first control valves that are open; and/or When the pressure difference between the outlet and the inlet of the branches is smaller than the second predetermined value, the first control module of the first pressure difference instructs to decrease the amount of the first control valves that are open; and/or When the pressure difference between the outlet and the inlet of the branches is between the first predetermined value and the second predetermined value, the first control module of the first pressure difference instructs to regulate the flow rate of the cooling medium in the air conditioning system, wherein the first predetermined value is greater than the second predetermined value.

In an embodiment of the method for controlling an air conditioning system according to the present invention, the power module further comprises a variable frequency pump for regulating the flow rate of the cooling medium, and the variable frequency pump communicates with the controller, and the controller further comprises a second control module of the first pressure difference that communicates with the variable frequency pump and the first pressure difference determination module.

In Step 4, the first pressure difference determination module determines the pressure difference between the outlet and the inlet of the branches and sends a signal to the second control module of the first pressure difference;

In Step 5, the second control module of the first pressure difference compares the pressure difference between the outlet and the inlet of the branches with a third predetermined value and a fourth predetermined value, If greater than the third predetermined value, then the second control module of the first pressure difference instructs to decrease the flow rate of the variable frequency pump;

If smaller than the fourth predetermined value, then the second control module of the first pressure difference instructs to increase the flow rate of the variable frequency pump;

If between the third predetermined value and the fourth predetermined value, then the second control module of the first pressure difference instructs to keep the flow rate of the variable frequency pump constant, Wherein the third predetermined value is greater than the fourth predetermined value, the third predetermined value is smaller than the first predetermined value, and the fourth predetermined value is greater than the second predetermined value.

In another embodiment of the method for controlling an air conditioning system according to the present invention, a second control valve is disposed on the bypass formed between the inlet and the outlet of the indoor subsystem for regulating the flow rate of the cooling medium entering the bypass, and the second control valve communicates with the controller, the air conditioning system further comprises a third pressure sensor for measuring the inlet pressure of the indoor subsystem and a fourth pressure sensor for measuring the outlet pressure of the indoor subsystem, the controller comprises a second pressure difference determination module that communicates with the third pressure sensor and the fourth pressure sensor, and a second pressure difference control module that communicates with the second control valve and the second pressure difference determination module, In Step 6, the second pressure difference determination module receives the inlet pressure and the outlet pressure of the indoor subsystem from the third pressure sensor and the fourth pressure sensor;

In Step 7, the second pressure difference determination module determines the pressure difference between the outlet and the inlet of the indoor subsystem, and sends a signal to the second pressure difference control module;

In Step 8, the second pressure difference control module compares the pressure difference between the outlet and the inlet of the indoor subsystem with a fifth predetermined value and a sixth predetermined value, If greater than the fifth predetermined value, then the second pressure difference control module instructs to increase the opening degree of the second control valve;

If smaller than the sixth predetermined value, then the second pressure difference control module instructs to decrease the opening degree of the second control valve;

If between the fifth predetermined value and the sixth predetermined value, then the second pressure difference control module instructs to keep the opening degree of the second control valve unchanged, Wherein the fifth predetermined value is greater than the sixth predetermined value.

According to a fourth aspect of the present invention, moreover, a method for controlling an air conditioning system is also provided, said air conditioning system comprising an outdoor subsystem, an indoor subsystem and a variable frequency pump for regulating the flow rate of a cooling medium, characterized in that the air conditioning system further comprises a controller, a first pressure sensor for measuring the inlet pressure of the outdoor subsystem, and a second pressure sensor for measuring the outlet pressure of the outdoor subsystem, the controller comprises a first pressure difference determination module that communicates with the first pressure sensor and the second pressure sensor, and a second control module of the first pressure difference that communicates with the first pressure difference determination module and the variable frequency pump, In Step 1, the first pressure difference determination module receives the inlet pressure of the outdoor subsystem and the outlet pressure of the outdoor subsystem from the first pressure sensor and the second pressure sensor;

In Step 2, the first pressure difference determination module determines the pressure difference between the outlet and the inlet of the outdoor subsystem;

In Step 3, the second control module of the first pressure difference compares the pressure difference between the outlet and the inlet of the outdoor subsystem with a third predetermined value and a fourth predetermined value, wherein, When the pressure difference between the outlet and the inlet of the outdoor subsystem is greater than the third predetermined value, the second control module of the first pressure difference instructs to decrease the flow rate of the variable frequency pump; and/or When the pressure difference between the outlet and the inlet of the outdoor subsystem is between the third predetermined value and the fourth predetermined value, the second control module of the first pressure difference instructs to keep the flow rate of the variable frequency pump constant; and/or When the pressure difference between the outlet and the inlet of the outdoor subsystem is smaller than the fourth predetermined value, the second control module of the first pressure difference instructs to increase the flow rate of the variable frequency pump, Wherein the third predetermined value is greater than the fourth predetermined value.

Those skilled in the art can easily understand that although the present invention has probably not listed all of its embodiments, reasonable combinations of the above technologies should also be essential parts of the present invention and shall be encompassed by the present invention.

The technology according to the present invention has the following advantageous effects: compared with the prior art, with the air conditioning system according to the present invention, the circulating return flow of the cooling medium in the air conditioning system can be regulated. Furthermore, the flow rate can be maintained steady. Furthermore, the amount of outdoor units is maximized. Furthermore, the pump's power demand is minimized. Furthermore, the energy consumption can be easily reduced.

BRIEF DESCRIPTION OF THE DRAWINGS

The technology according to the present invention will be described in detail below with reference to the accompanying drawings and embodiments, wherein.

Description of legends in the figures

| | | | |
|---|---|---|---|
| 1 | air conditioning system | 2 | indoor unit |
| 3 | power module | 4 | branch |
| 5 | outdoor unit | 6 | first control valve |
| 7 | controller | 8 | first pressure sensor |
| 9 | second pressure sensor | 10 | variable frequency pump |
| 11 | bypass | 12 | second control valve |
| 13 | third pressure sensor | 14 | fourth pressure sensor |
| 15 | buffer tank | 16 | expansion water tank |

DETAILED DESCRIPTION OF THE PREFERRED EMBODIMENT

One embodiment of the present invention will be described in detail below with reference to the accompanying drawings. It should be understood that the detailed description of the specific embodiment is used to describe and explain the present invention, rather than to limit the present invention.

Figure 1:
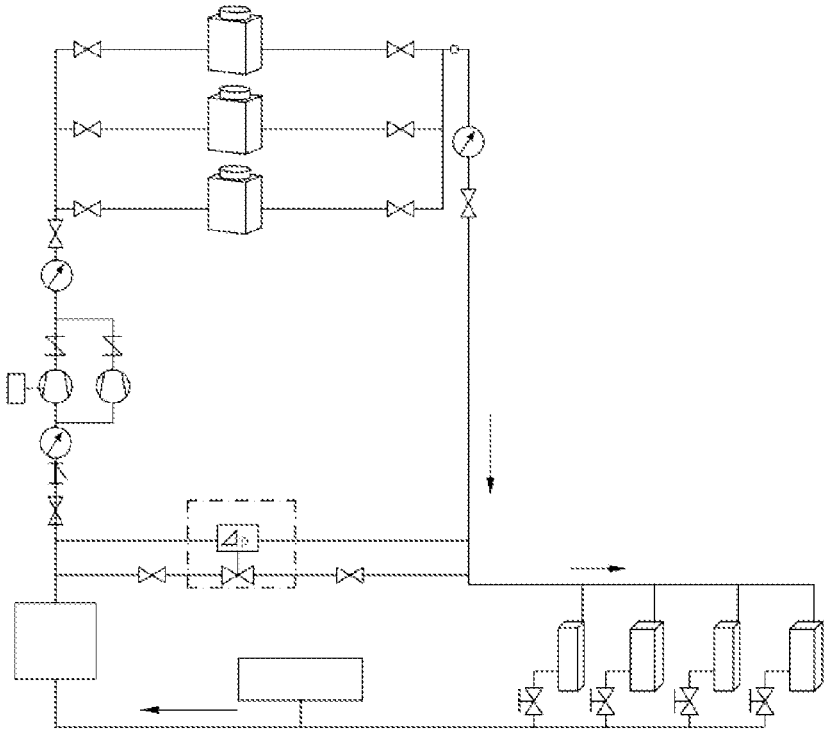
FIG. 1 illustrates an air conditioning system according to the prior art.
Figure 2:
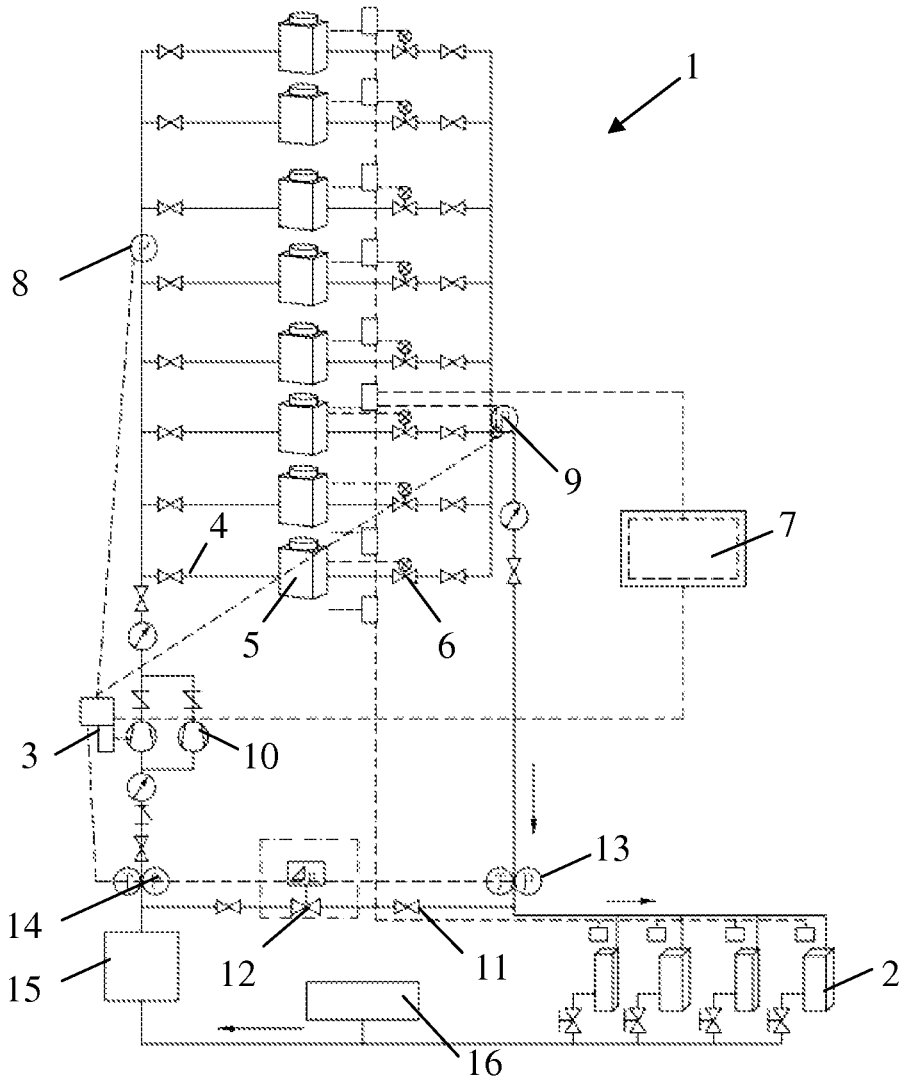
FIG. 2 illustrates an embodiment of the air conditioning system according to the present invention.

As shown in FIG. 2, it illustratively shows the overall structure of an embodiment of the air conditioning system according to the present invention. it can be seen from the illustrated embodiment that the air conditioning system 1 comprises an outdoor subsystem, an indoor subsystem having a number of indoor units 2 and a power module 3 for driving a cooling medium to circulate in the entire air conditioning system, the outdoor subsystem is configured with a plurality of branches 4 arranged in parallel (namely two or more branches, 8 branches in the figure in the present invention), the branches 4 comprise a branch inlet and a branch outlet, and each branch is configured with an outdoor unit 5 and a first control valve 6. The air conditioning system 1 further comprises a controller 7, a first pressure sensor 8 and a second pressure sensor 9, the first pressure sensor 8 and the second pressure sensor 9 being used for measuring the pressure at the branch inlet and the pressure at the branch outlet, respectively.

In the present embodiment, the controller 7 comprises a first pressure difference determination module that communicates with the first pressure sensor 8 and the second pressure sensor 9, and a first control module of the first pressure difference that communicates with the first control valve 6 and the first pressure difference determination module, the first pressure difference determination module receives the pressure at the branch inlet and the pressure at the branch outlet from the first pressure sensor 8 and the second pressure sensor 9, and determines the pressure difference between the outlet and the inlet of the branches 4. The main role of the controller 7 is to control the operation of the entire air conditioning system, which may comprise control units with different functions as needed. For example, the controller 7 may receive signals from all sensors in the system for logical operations and data processing, and at the same time, send execution instructs to an execution mechanism. The first control valve 6 is optionally a solenoid valve.

From the arrows in the figure, the flow sequence of the cooling medium in the air conditioning system can be clearly seen: the cooling medium flows into the indoor subsystem through the power module 3 and the outdoor subsystem, performs heat exchange with the indoor air in the indoor unit 2 of the indoor subsystem, and subsequently returns to the outdoor unit 5 of the outdoor subsystem through the power module 3 for heat exchange, thereby forming a circulation of the cooling medium. The cooling medium herein may be selected to be cooling water or a mixed solution of cooling water and a refrigerant, the refrigerant being, for example, an ethylene glycol mixed solution.

It should be noted that circulation loops, such as coolant loops, indoor air delivery loops and waterways for heat dissipation, are usually configured inside an air conditioning system. To better illustrate the present invention, the coolant loop, indoor air delivery loop, etc. in the air conditioning system are omitted herein. In addition, the outdoor unit, the power module and the indoor unit are all components well known to those skilled in the art, which, therefore, will not be described in detail herein. For example, the outdoor unit may be a commercial chiller commonly seen in large shops or office buildings, and the indoor unit may be a part for making the indoor air and the cooling medium in the indoor unit to perform heat exchange, for example, a Fan Coil Unit (FCU).

In practical operations, to control the amount of the outdoor units 5 that are open and to prevent the outdoor units 5 from being turned on and off too frequently, the outdoor subsystem of the air conditioning system 1 is designed to have three operational states: load control state, passive control state and shutdown state. The load control state means that when the pressure difference between the outlet and the inlet of the branches 4 measured by the first pressure difference determination module is greater than a first predetermined value, the first control module of the first pressure difference in the controller 7 instructs to increase the amount of the first control valves 6 on the branches 4 in the outdoor subsystem that are open; the shutdown state means that when the pressure difference between the outlet and the inlet of the branches 4 measured by the first pressure difference determination module is smaller than a second predetermined value, the first control module of the first pressure difference in the controller 7 instructs to decrease the amount of the first control valves 6 on the branches 4 in the outdoor subsystem 1 that are open, and the passive control state means that when the pressure difference between the outlet and the inlet of the branches 4 measured by the first pressure difference determination module is between the first predetermined value and the second predetermined value, the first control module of the first pressure difference in the controller 7 instructs to regulate the flow rate of the cooling medium in the air conditioning system, wherein the first predetermined value is set to be greater than the second predetermined value.

It should be noted that the first predetermined value and the second predetermined value here are values set according to the actual load on the outdoor units of the air conditioning system. The first predetermined value is a product of the pressure difference value set for outdoor units and a first predetermined percent (the first predetermined percent may be set to 40% or other values), and the second predetermined value is a product of the pressure difference value set for outdoor units and a second predetermined percent (the second predetermined percent may be set to 25% or other values). At the same time, it should be noted that the values containing "predetermined" herein refer to values that are set in advance, which may be set according to different actual needs.

In an alternative embodiment, the power module 3 in the air conditioning system 1 may further comprise a variable frequency pump 10 for better regulating the flow rate of the cooling medium into the indoor subsystem. The controller 7 further comprises a second control module of the first pressure difference that communicates with the variable frequency pump 10 and the first pressure difference determination module, the first pressure difference determination module receives the pressure at the branch inlet and the pressure at the branch outlet in the outdoor subsystem from the first pressure sensor 8 and the second pressure sensor 9, determines the pressure difference between the outlet and the inlet of the branches 4, and sends a signal to the second control module of the first pressure difference; the second control module of the first pressure difference determines that the pressure difference between the outlet and the inlet of the branches 4 is greater than a third predetermined value, then the second control module of the first pressure difference in the controller 7 instructs to decrease the flow rate of the variable frequency pump 10 (until the frequency of the variable frequency pump reaches its set minimum value); the second control module of the first pressure difference determines that the pressure difference between the outlet and the inlet of the branches 4 is smaller than a fourth predetermined value, then the second control module of the first pressure difference in the controller 7 instructs to increase the flow rate of the variable frequency pump 10 (until the frequency of the variable frequency pump reaches its set maximum value); the second control module of the first pressure difference determines that the pressure difference between the outlet and the inlet of the branches 4 is between the third predetermined value and the fourth predetermined value, then the second control module of the first pressure difference in the controller 7 instructs to keep the flow rate of the variable frequency pump 10 constant, wherein the third predetermined value is set to be greater than the fourth predetermined value, the third predetermined value is set to be smaller than the first predetermined value, and the fourth predetermined value is set to be greater than the second predetermined value.

The above embodiment is combined with other embodiments. To strike a balance of flow rate between the indoor subsystem and the outdoor subsystem, a second control valve 12 is disposed on the bypass 11 formed between the inlet and the outlet of the indoor subsystem. The air conditioning system 1 further comprises a third pressure sensor 13 for measuring the inlet pressure of the indoor subsystem and a fourth pressure sensor 14 for measuring the outlet pressure of the indoor subsystem. The controller 7 comprises a second pressure difference determination module that communicates with the third pressure sensor 13 and the fourth pressure sensor 14, and a second pressure difference control module that communicates with the second control valve 12 and the second pressure difference determination module, the second pressure difference determination module receives the inlet pressure and the outlet pressure of the indoor subsystem from the third pressure sensor 13 and the fourth pressure sensor 14, determines the pressure difference between the outlet and the inlet of the indoor subsystem, and sends a signal to the second pressure difference control module; the second pressure difference control module determines that the pressure difference between the outlet and the inlet of the indoor subsystem is greater than a fifth predetermined value, then the second pressure difference control module in controller 7 instructs to increase the opening degree of the second control valve 12 (until the second control valve 12 is opened to the maximum degree); the second pressure difference control module determines that the pressure difference between the outlet and the inlet of the indoor subsystem is smaller than a sixth predetermined value, then the second pressure difference control module in controller 7 instructs to decrease the opening degree of the second control valve 12 (until the second control valve 12 is completely closed); when the second pressure difference control module determines that the pressure difference between the outlet and the inlet of the indoor subsystem is between the fifth predetermined value and the sixth predetermined value, the second pressure difference control module in controller 7 instructs to keep the opening degree of the second control valve 12 unchanged, wherein the fifth predetermined value is set to be greater than the sixth predetermined value. Moreover, it should be easy to understand that the settings of the fifth predetermined value and the sixth predetermined value may vary with changes to the amount of the indoor subsystems.

According to another embodiment of the present invention, moreover, the air conditioning system 1 according to the present invention comprises an outdoor subsystem, an indoor subsystem and a variable frequency pump 10 for regulating the flow rate of a cooling medium, the air conditioning system further comprises a controller 7, a first pressure sensor 8 for measuring the inlet pressure of the outdoor subsystem, and a second pressure sensor 9 for measuring the outlet pressure of the outdoor subsystem, the controller comprises a first pressure difference determination module that communicates with the first pressure sensor 8 and the second pressure sensor 9, and a second control module of the first pressure difference that communicates with the first pressure difference determination module and the variable frequency pump, wherein the first pressure difference determination module receives the inlet pressure of the outdoor subsystem and the outlet pressure of the outdoor subsystem from the first pressure sensor and the second pressure sensor, and determines the pressure difference between the outlet and the inlet of the outdoor subsystem.

In this embodiment, the pressure difference between the outlet and the inlet of the outdoor subsystem measured by the first pressure difference determination module is greater than a third predetermined value, then the second control module of the first pressure difference instructs to decrease the flow rate of the variable frequency pump, and/or the pressure difference between the outlet and the inlet of the outdoor subsystem measured by the first pressure difference determination module is between the third predetermined value and a fourth predetermined value, then the second control module of the first pressure difference instructs to keep the flow rate of the variable frequency pump constant; and/or the pressure difference between the outlet and the inlet of the outdoor subsystem measured by the first pressure difference determination module is smaller than the fourth predetermined value, then the second control module of the first pressure difference instructs to increase the flow rate of the variable frequency pump, wherein the third predetermined value is greater than the fourth predetermined value.

In the above embodiments of the present invention, moreover, the air conditioning system may further be configured with a buffer tank 15 for better regulating the flow inertia of the cooling medium in the air conditioning system, and consequently obtaining a more steady flow. Moreover, an expansion water tank 16 may be designed in the air conditioning system for water replenishing and pressure stabilization.

In an embodiment of the present invention, a method for controlling the air conditioning system according to the present invention comprises the following steps.

In Step 1, the first pressure difference determination module receives the pressure at the branch inlet and the pressure at the branch outlet from the first pressure sensor and the second pressure sensor;

In Step 2, the first pressure difference determination module determines the pressure difference between the outlet and the inlet of the branches;

In Step 3, the first control module of the first pressure difference compares the pressure difference between the outlet and the inlet of the branches with a first predetermined value and a second predetermined value, wherein, When the pressure difference between the outlet and the inlet of the branches is greater than the first predetermined value, the first control module of the first pressure difference instructs to increase the amount of the first control valves that are open; and/or When the pressure difference between the outlet and the inlet of the branches is smaller than the second predetermined value, the first control module of the first pressure difference instructs to decrease the amount of the first control valves that are open; and/or When the pressure difference between the outlet and the inlet of the branches is between the first predetermined value and the second predetermined value, the first control module of the first pressure difference instructs to regulate the flow rate of the cooling medium in the air conditioning system, wherein the first predetermined value is greater than the second predetermined value.

Moreover, the control method according to the present invention may further comprise Step 4, the first pressure difference determination module determines the pressure difference between the outlet and the inlet of the branches and sends a signal to the second control module of the first pressure difference;

The control method according to the present invention may further comprise Step 5, the second control module of the first pressure difference compares the pressure difference between the outlet and the inlet of the branches with a third predetermined value and a fourth predetermined value, If greater than the third predetermined value, then the second control module of the first pressure difference instructs to decrease the flow rate of the variable frequency pump (until the frequency of the variable frequency pump reaches its set minimum value);

If smaller than the fourth predetermined value, then the second control module of the first pressure difference instructs to increase the flow rate of the variable frequency pump (until the frequency of the variable frequency pump reaches its set maximum value);

If between the third predetermined value and the fourth predetermined value, then the second control module of the first pressure difference instructs to keep the flow rate of the variable frequency pump constant, Wherein the third predetermined value is greater than the fourth predetermined value, the third predetermined value is smaller than the first predetermined value, and the fourth predetermined value is greater than the second predetermined value.

The control method according to the present invention may further comprise Step 6, the second pressure difference determination module receives the inlet pressure and the outlet pressure of the indoor subsystem from the third pressure sensor and the fourth pressure sensor;

The control method according to the present invention may further comprise Step 7, the second pressure difference determination module determines the pressure difference between the outlet and the inlet of the indoor subsystem, and sends a signal to the second pressure difference control module;

The control method according to the present invention may further comprise Step 8, the second pressure difference control module compares the pressure difference between the outlet and the inlet of the indoor subsystem with a fifth predetermined value and a sixth predetermined value, If greater than the fifth predetermined value, then the second pressure difference control module instructs to increase the opening degree of the second control valve (until the second control valve is opened to the maximum degree);

If smaller than the sixth predetermined value, then the second pressure difference control module instructs to decrease the opening degree of the second control valve (until the second control valve is completely closed);

If between the fifth predetermined value and the sixth predetermined value, then the second pressure difference control module instructs to keep the opening degree of the second control valve unchanged, Wherein the fifth predetermined value is greater than the sixth predetermined value.

In another embodiment of the present invention, a method for controlling the air conditioning system according to the present invention comprises the following steps.

In Step 1, the first pressure difference determination module receives the inlet pressure of the outdoor subsystem and the outlet pressure of the outdoor subsystem from the first pressure sensor and the second pressure sensor;

In Step 2, the first pressure difference determination module determines the pressure difference between the outlet and the inlet of the outdoor subsystem;

In Step 3, the second control module of the first pressure difference compares the pressure difference between the outlet and the inlet of the outdoor subsystem with a third predetermined value and a fourth predetermined value, wherein, When the pressure difference between the outlet and the inlet of the outdoor subsystem is greater than the third predetermined value, the second control module of the first pressure difference instructs to decrease the flow rate of the variable frequency pump; and/or When the pressure difference between the outlet and the inlet of the outdoor subsystem is between the third predetermined value and the fourth predetermined value, the second control module of the first pressure difference instructs to keep the flow rate of the variable frequency pump constant; and/or When the pressure difference between the outlet and the inlet of the outdoor subsystem is smaller than the fourth predetermined value, the second control module of the first pressure difference instructs to increase the flow rate of the variable frequency pump, Wherein the third predetermined value is greater than the fourth predetermined value.

Experimental data have shown that compared with the prior art, the air conditioning system according to the present invention can save more than 30% of energy consumption for the variable frequency pump in the power module. Moreover, the air conditioning system can effectively control the flow rate in the cooling medium circulation loop. Even when the demand of indoor units changes, the air conditioning system can respond quickly such that the flow rate in the entire cooling medium circulation loop always remains constant. In short, with advantages of high energy saving, strong operability and strong stability, the air conditioning system is able to not only meet the cooling or heating demand of an indoor subsystem, but also satisfy the concept of being green, environmentally friendly and low carbon. Therefore, it should be promoted in large business buildings and other high-rises.

A number of specific embodiments are listed above to describe in detail the air conditioning system according to the present invention and the control method for the air conditioning system. These individual embodiments are only used to describe the principle and implementation of the present invention, rather than to restrict the present invention. Without departing from the spirit and scope of the present invention, those skilled in the art may further make various variations and improvements. For example, the number of branches in the outdoor subsystem is not limited to 8 herein, which may be designed to be 4, 5, 6 or more according to various actual situations. Similarly, it should be understood that corresponding control units may be added or removed in the controller in the air conditioning system according to the present invention as needed. For example, this system may be used in combination with a temperature sensor to assist the control of the flow rate in the air conditioning system through temperature difference. In such a circumstance, a temperature difference control unit needs to be added into the controller. In certain applications or according to actual demands, moreover, various modifications to the type and arrangement of the outdoor unit on each branch are acceptable. Therefore, all equivalent technologies shall be encompassed by the scope of the present invention and defined by the claims of the present invention.

The invention claimed is:

1. An air conditioning system, which comprises an outdoor subsystem, an indoor subsystem and a power module for driving a cooling medium, wherein the outdoor subsystem is configured with a plurality of parallel branches and said branches comprise a branch inlet and a branch outlet, wherein the cooling medium flows into the indoor subsystem through the power module and the outdoor subsystem, performs heat exchange with the indoor air in an indoor unit of the indoor subsystem, and subsequently returns to an outdoor unit of the outdoor subsystem through the power module for heat exchange, thereby forming a circulation of the cooling medium, wherein:

each branch is configured with an outdoor unit and a first control valve, the air conditioning system further comprises a controller, a first pressure sensor for measuring a pressure at the branch inlet and a second pressure sensor for measuring the pressure at the branch outlet, the controller comprises a first pressure difference determination module that communicates with the first pressure sensor and the second pressure sensor, and a first control module that communicates with the first pressure difference determination module and the first control valve, wherein the first pressure difference determination module receives the pressure at the branch inlet and the pressure at the branch outlet from the first pressure sensor and the second pressure sensor, and determines the pressure difference between the outlet and the inlet of the branches.

2. The air conditioning system as set forth in claim 1, wherein the pressure difference between the outlet and the inlet of the branches measured by the first pressure difference determination module is greater than a first predetermined value, then the first control module of the first pressure difference instructs to increase an amount of the first control valves that are open; and/or when the pressure difference between the outlet and the inlet of the branches measured by the first pressure difference determination module is between the first predetermined value and a second predetermined value, then the first control module of the first pressure difference instructs to regulate the flow rate of the cooling medium in the air conditioning system, and/or;

when the pressure difference between the outlet and the inlet of the branches measured by the first pressure difference determination module is smaller than the second predetermined value, then the first control module of the first pressure difference instructs to decrease the amount of the first control valves that are open;

wherein the first predetermined value is greater than the second predetermined value.

3. The air conditioning system as set forth in claim 2, wherein the power module further comprises a variable frequency pump for regulating the flow rate of the cooling medium, and the controller further comprises a second control module of the first pressure difference that communicates with the variable frequency pump and the first pressure difference determination module.

4. The air conditioning system as set forth in claim 3, wherein the pressure difference between the outlet and the inlet of the branches measured by the first pressure difference determination module is greater than a third predetermined value, then the second control module of the first pressure difference instructs to decrease the flow rate of the variable frequency pump; and/or the pressure difference between the outlet and the inlet of the branches measured by the first pressure difference determination module is smaller than a fourth predetermined value, then the second control module of the first pressure difference instructs to increase the flow rate of the variable frequency pump; and/or the pressure difference between the outlet and the inlet of the branches measured by the first pressure difference determination module is between the third predetermined value and the fourth predetermined value, then the second control module of the first pressure difference instructs to keep the flow rate of the variable frequency pump constant;

wherein the third predetermined value is greater than the fourth predetermined value, the third predetermined value is smaller than the first predetermined value, and the fourth predetermined value is greater than the second predetermined value.

5. The air conditioning system as set forth in claim 4, wherein a second control valve is disposed on the bypass formed between the inlet and the outlet of the indoor subsystem, the air conditioning system further comprises a third pressure sensor for measuring the inlet pressure of the indoor subsystem and a fourth pressure sensor for measuring the outlet pressure of the indoor subsystem, the controller comprises a second pressure difference determination module that communicates with the third pressure sensor and the fourth pressure sensor, the second pressure difference determination module receives the inlet pressure and the outlet pressure of the indoor subsystem from the third pressure sensor and the fourth pressure sensor, and determines the pressure difference between the outlet and the inlet of the indoor subsystem, and the controller further comprises a second pressure difference control module that communicates with the second control valve and the second pressure difference determination module.

6. The air conditioning system as set forth in claim 5, wherein the pressure difference between the outlet and the inlet of the indoor subsystem measured by the second pressure difference determination module is greater than a fifth predetermined value, then the second pressure difference control module instructs to increase the opening degree of the second control valve; and/or the pressure difference between the outlet and the inlet of the indoor subsystem measured by the second pressure difference determination module is smaller than a sixth predetermined value, then the second pressure difference control module instructs to decrease the opening degree of the second control valve, and/or the pressure difference between the outlet and the inlet of the indoor subsystem measured by the second pressure difference determination module is between the fifth predetermined value and the sixth predetermined value, then the second pressure difference control module instructs to keep the opening degree of the second control valve unchanged;

wherein the fifth predetermined value is greater than the sixth predetermined value.

7. The air conditioning system as set forth in claim 1, wherein the first control valve is a solenoid valve.

8. The air conditioning system as set forth in claim 1, wherein the cooling medium is cooling water.

* * * * *